US005425444A

United States Patent [19]

Chapman

[11] Patent Number: 5,425,444

[45] Date of Patent: Jun. 20, 1995

[54] NECKLACE HOLDER FOR STORAGE AND DISPLAY

[76] Inventor: Frances V. Chapman, 18 Stone St., Macedon, N.Y. 14502

[21] Appl. No.: 186,339

[22] Filed: Jan. 25, 1994

[51] Int. Cl.[6] ..... A45C 11/16; B65D 1/34

[52] U.S. Cl. ..... 206/6.1; 206/566; 206/348; 248/309.1

[58] Field of Search ..... 206/6.1, 566, 560, 348, 206/49, 388; 248/309.1, 309.2; 211/89, 13

[56] References Cited

U.S. PATENT DOCUMENTS

| | | | |
|---|---|---|---|
| 514,050 | 2/1894 | Wesely | 206/566 |
| 549,970 | 11/1895 | Lawrence | 206/566 |
| 579,523 | 3/1897 | Turner | 206/388 |
| 649,495 | 5/1900 | Sweeney | 206/388 |
| 1,639,672 | 8/1927 | Schraysshuen | 206/348 |
| 2,624,457 | 1/1953 | Jablon | 206/348 |
| 3,648,831 | 3/1972 | Arnone | 206/566 |
| 4,016,972 | 4/1977 | Szamborski | 206/566 |
| 4,552,264 | 11/1985 | Quarrell et al. | 206/566 |
| 4,905,948 | 3/1990 | Indorf | 248/309.1 |
| 5,129,510 | 7/1992 | Wright | 206/6.1 |

FOREIGN PATENT DOCUMENTS

| | | | |
|---|---|---|---|
| 0062613 | 10/1982 | European Pat. Off. | 206/566 |

*Primary Examiner*—David T. Fidei
*Assistant Examiner*—Marie Denise Patterson
*Attorney, Agent, or Firm*—Robert J. Bird

[57] ABSTRACT

A necklace holder includes a supporting base and opposed tees mounted on the base and urged apart by a compression spring. The opposed tees each include a crossbar with a lengthwise channel. The tees are urged apart against a necklace looped around the crossbars and within the channels.

2 Claims, 2 Drawing Sheets

NECKLACE HOLDER FOR STORAGE AND DISPLAY

FIELD OF THE INVENTION

This invention is a necklace holder for storage and display of a necklace.

BACKGROUND INFORMATION

A necklace, when it is not being worn, is typically kept in a jewelry box, tray, or drawer, laid out limply or even in a pile. If two or more necklaces are stored together like this they are likely to become tangled in each other, and the probability of this increases greatly with the number of necklaces. Necklaces are also sometimes stored by hanging on hooks, but the same general problem exists. Several necklaces hanging on the same hook can become entangled.

The prior art includes U.S. Pat. No. 5,129,5 10 to Wright in which a necklace storage device includes a supporting base, a fixed post at one end, and a lengthwise movable post. A necklace is placed around the posts, and the movable post moved and locked at a position at which the necklace is relatively taut and captured on the two posts. Use of the Wright device involves the application of torque to turn and lock the movable post.

SUMMARY OF THE INVENTION

My necklace holder includes a base supporting an inverted tee which includes a vertical tube and a bottom crossbar with a channel along its bottom, An upright tee includes a vertical spindle and a top crossbar with a channel along its top. The upright tee is movable up and down on a spring in the vertical tube to urge the tees apart against a necklace looped around the crossbars. Hooks on the supporting base anchor the ends of the necklace.

DRAWING

DESCRIPTION

Figure 1:
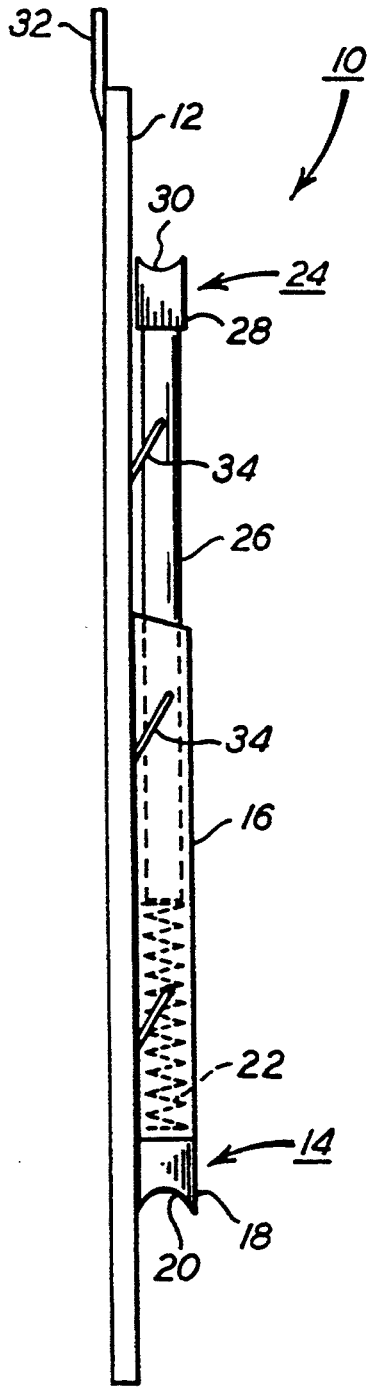
FIG. 1 is a left side of a necklace holder according to my invention.
Figure 2:
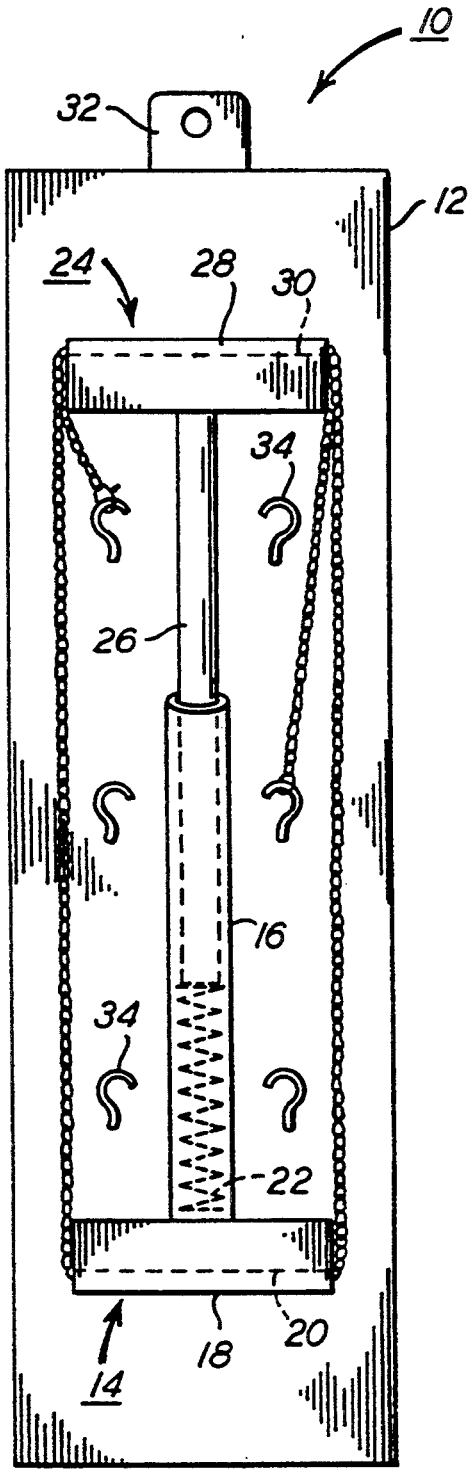
FIG. 2 is a front view of the holder of FIG. 1.

Referring to FIGS. 1 and 2, my necklace holder 10 includes a supporting base 12 with a hang tab 32 at one end. An inverted tee 14 is mounted on the supporting base 12, and includes a vertical tube 16 and a bottom crossbar 18 across its lower end. An upright tee 24 includes a vertical spindle 26 and a top crossbar 28 across its upper end. The vertical spindle 26 is slidable in the tube 16. That is, the upright tee 24 is movable up and down relative to the inverted tee 14. The spindle 26 rests on a light compression spring 22 in the bottom of the tube 16. Hooks 34 are mounted at convenient locations on the supporting base 12. Six of these hooks are shown in the examples.

As best seen in FIG. 1, the top crossbar 28 includes a channel 30 along its top, and the bottom crossbar 18 includes a channel 20 along its bottom. The channels 20, 30 keep the necklace securely in place on the holder.

A necklace is placed on the holder 10 by pushing the upright tee 24 down against the compression spring 22 and placing the necklace within the bottom and top channels 20, 30. The compression spring 22 is then allowed to push the tee 24 back up against the necklace to hold it securely in place. If the necklace is a closed loop, nothing else is required.

An open necklace, by which I mean a necklace which opens and closes with a fastener, is stored in the holder 10 in its open unfastened condition. In this case, it is necessary to secure the open ends of the necklace, and so they are anchored to two of the hooks 34 as shown in FIG. 2.

The necklace holder 10 may be made of a transparent plastic material for economy, or of wood or some other material for aesthetic appeal. The necklace holder may be hung from a hook, in which case the hang tab 32 is required, or it may be laid flat in a box or drawer, in which case the hang tab is not required. In other words, the hang tab 32 may be desirable for some applications and not for others, and so it is preferably removable.

Figure 3:
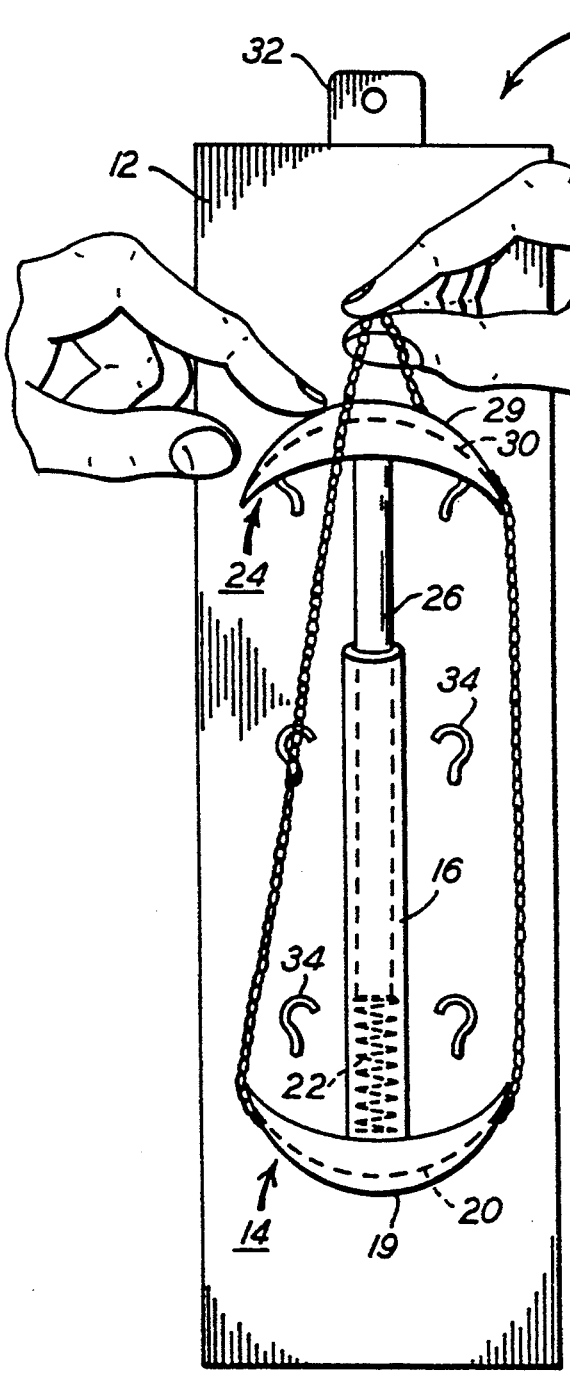
FIGS. 3 and 4 are front views of a modified form of my necklace holder.
Figure 4:
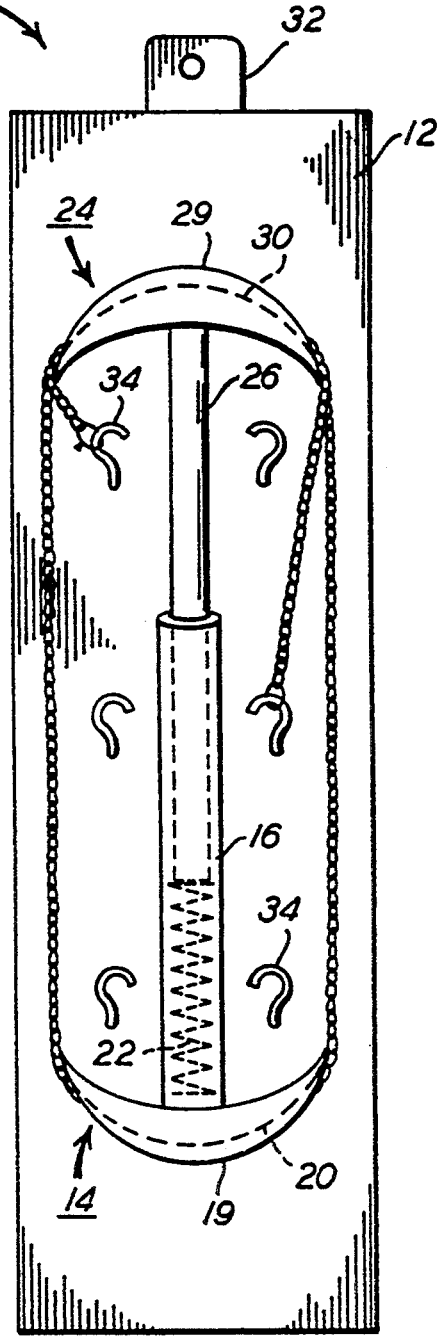

FIGS. 3 and 4 show a modified form of my necklace holder, in use with a closed necklace and an open necklace respectively. In this modification, the top and bottom crossbars 29 and 19 are arched as shown to provide a curved shape for necklace support without sharp or abrupt corners. As in FIG. 2, the arched crossbars 19 and 29 include channels 20 and 30 respectively to keep the necklace securely in place on the holder.

The foregoing description of a preferred embodiment of this invention, including any dimensions, angles, or proportions, is intended as illustrative. The concept and scope of the invention are limited only by the following claims and equivalents thereof.

What is claimed is:

1. A necklace holder, including:

a supporting base;

opposed tees mounted on said base and urged apart by a compression spring;

each of said tees including, at the remote end thereof, a crossbar with a channel therealong, said opposed tees adapted to support a necklace looped around said crossbars and within said channels; and a plurality of hooks spaced apart on said supporting base for selective engagement with ends of an open necklace to anchor said ends of said necklace to said base.

2. A necklace holder, including:

a supporting base;

an inverted tee mounted on said supporting base and including a vertical tube and an arcuate bottom crossbar with a channel along the arcuate bottom thereof;

an upright tee including a vertical spindle and an arcuate too crossbar with a channel along the arcuate top thereof, said spindle being movable up and down in said tube;

a compression spring in said vertical tube under said spindle to urge said tees apart against a necklace looped around said crossbars within said channels; and a plurality of hooks spaced apart on said supporting base for selective engagement with ends of an open necklace to anchor said ends of said necklace to said base.

* * * * *